United States Patent [19]

Kim

[11] 4,035,855

[45] July 19, 1977

[54] CAMPING PACK

[76] Inventor: Sung Bong Kim, 10411 Fyfe Court, Fairfax, Va. 22030

[21] Appl. No.: 657,970

[22] Filed: Feb. 13, 1976

[51] Int. Cl.[2] ..... A47G 9/00

[52] U.S. Cl. ..... 5/343; 224/10

[58] Field of Search ..... 224/9, 10; 5/343, 344, 5/113, 121

[56] References Cited

U.S. PATENT DOCUMENTS

| | | | |
|---|---|---|---|
| 510,239 | 12/1893 | Carr | 224/10 |
| 872,404 | 12/1907 | Burch | 5/343 |
| 2,971,205 | 2/1961 | Shultz | 5/343 |
| 3,041,638 | 7/1962 | LoVico | 5/343 X |
| 3,483,575 | 12/1969 | McCarthy | 5/344 X |

*Primary Examiner*—Paul R. Gilliam
*Assistant Examiner*—V. N. Sakran
*Attorney, Agent, or Firm*—Shlesinger, Arkwright, Garvey & Dinsmore

[57] ABSTRACT

A camping pack which comprises a tent assembly, a sleeping bag assembly, each of said assemblies being joined to each other, said assemblies forming in non-assembled position a substantially plainer, sheet-like article having four panels, each of said panels having at each end thereof a flap, and said pack including fastening means for securing said flaps and panels together into one or the other of said assemblies.

16 Claims, 9 Drawing Figures

Fig. 1
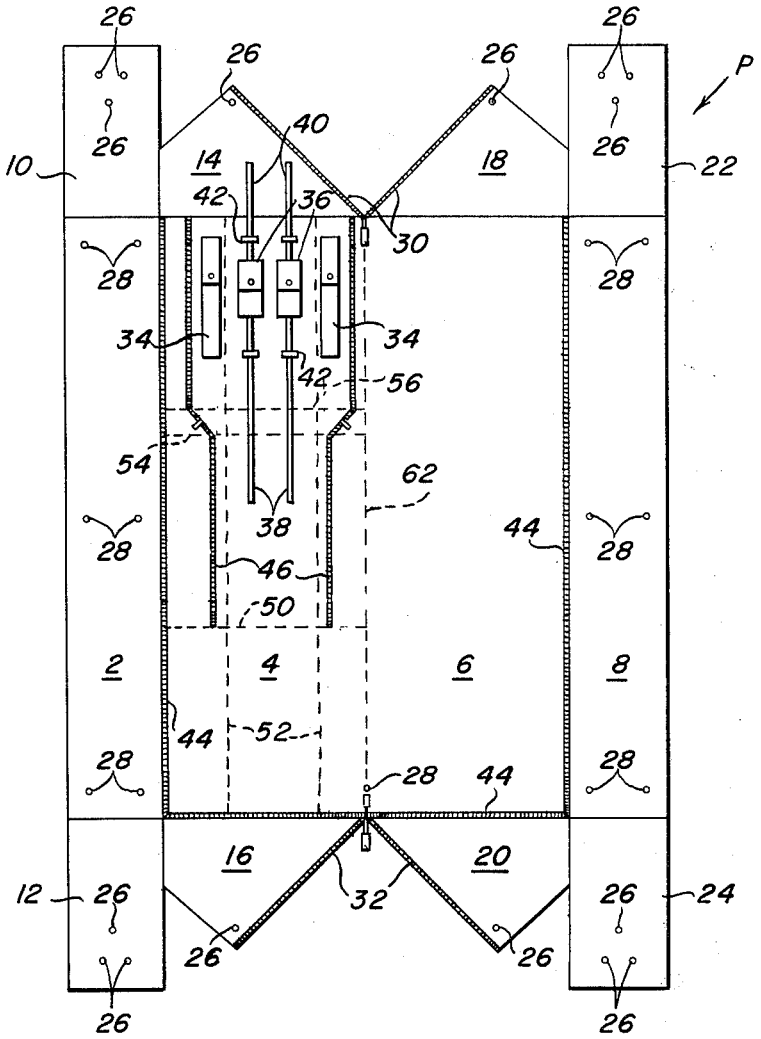
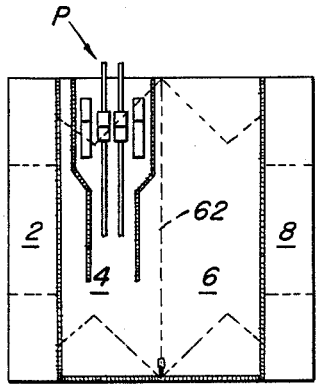
Fig. 2
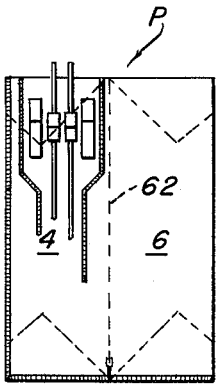
Fig. 3
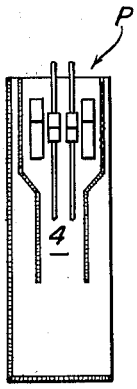
Fig. 4

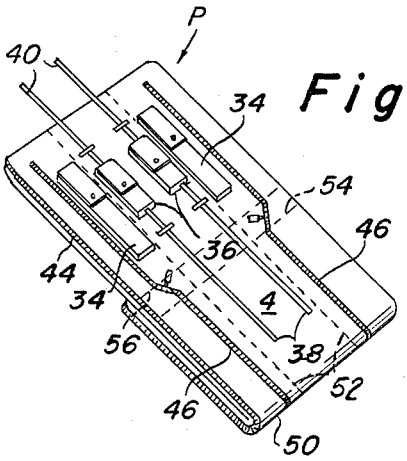
Fig.5
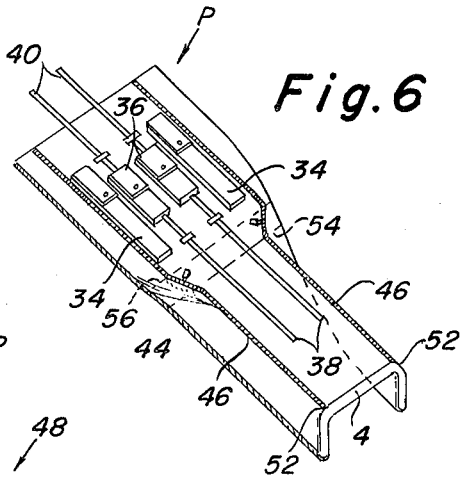
Fig.6
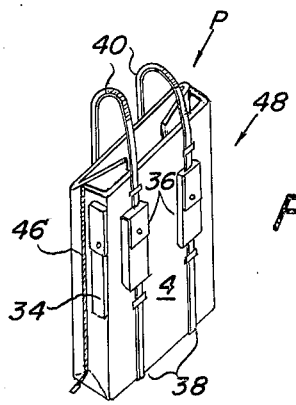
Fig.7
Fig.8
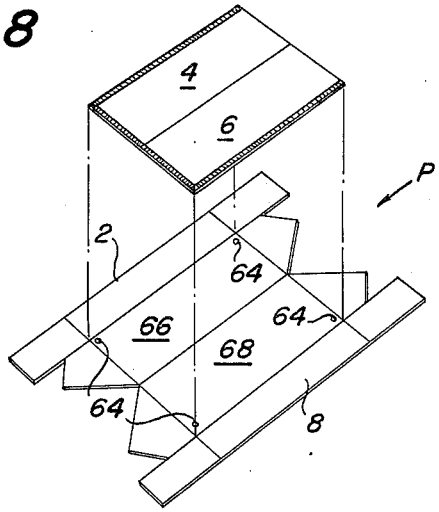
Fig.9
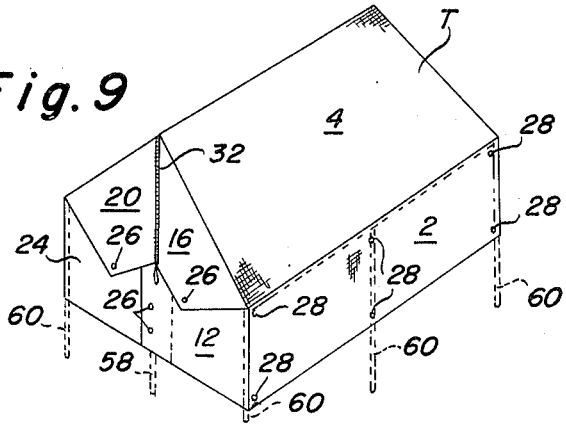

CAMPING PACK

FIELD OF INVENTION

This invention relates to camping packs and more specifically to a camping pack which is unitary and includes a tent, a sleeping bag, and carrying kit means for the tent and sleeping bag.

HISTORICAL BACKGROUND

Camping packs having combination features are well-known in the art. U.S. Pat. Nos. Brecht, 36,685; Jacob, 598,995; Burch, 872,404; and Abbot, 41,418 are very early patents showing combination packs which can be converted into either a tent, or a knapsack, or a sleeping bag, or both. More recent developments such as U.S. Pat. Nos. Shultz, 2,971,205, Lovico, 3,041,638; and McCarthy, 3,483,575 disclose the advances in combination type developments. In most instances, there was a singular failure to provide a three function pack which included a sleeping bag, tent and knapsack. Wherever such combination was attempted, problems were to be found in folding, compactness and overall utility.

OBJECTS AND SUMMARY

It is therefore an object of this invention to provide a camping pack or knapsack which is lightweight and versatile and includes the capability of providing a tent, or a sleeping bag, or both and which includes the capability of being assembled into a knapsack for ready transport.

A further object of this invention is to provide a lightweight utilitarian pack for use in the field as a tent having minimum assembly problems.

Yet another object of this invention is to provide a pack which can be readily assembled or disassembled into its various components.

Still another object of this invention is to provide a pack which includes a warm and serviceable zipped-up sleeping bag.

In summary therefore, this invention is directed to camping packs which have the capability of being converted readily and easily into a tent, or camping bag, or both from a carrying kit or knapsack.

In the accompanying drawings which illustrate by way of example various embodiments of this invention:

FIG. 1 is a top planned view of this invention.

FIG. 2 is a top planned view of this invention with the flaps folded underneath.

FIG. 3 is a top planned view of this invention with the end panels folded underneath.

FIG. 4 is a top planned view of this invention showing the assembled sleeping bag.

FIG. 5 is a perspective view showing the bottom portion of the sleeping bag being folded under for the purpose of showing the first step in the assembly operation of the carrying kit.

FIG. 6 is a perspective view showing the second stage of formation of the carrying kit.

FIG. 7 is a perspective showing the carrying kit in assembled position.

FIG. 8 is an exploded view of a modification of this invention showing how the sleeping bag may be removed from the tent assembly.

FIG. 9 shows the tent assembly in erected position.

FIGS. 1 THROUGH 4

The pack generally indicated at P is comprised of panels 2, 4, 6 and 8. Panel 2 has end flaps 10 and 12 which are rectangular. Panel 4 has end flaps 14 and 16 which are generally triangular. Panel 6 is a mere image of panel 4 and includes also generally triangular shaped end flaps 18 and 20. Panel 8 includes rectangular end flaps 22 and 24.

Snap fastening means 26 are shown on the various flaps. Stake or post support means 28 for securing the necessary tent stakes for maintaining the tent in erect position are generally shown. It will be obvious that the materials used in the pack may be specially water treated canvas, plastic, or the like. The stake support means 28 may include eyelets with reinforced rivets, straps, or the like. The snap fastening means 26 may include Velcro, buttons, or the like.

Flaps 14 and 18 form a pair of adjacent flaps which include a zipper 30, a portion of which extends along the adjacent edges for zipping flaps 14 and 18 together. Similarly, a zipper 32 is provided for zipping flaps 16 and 20 together.

Panel 4 includes pockets 34 and 36. Pockets 34 may receive ridge tent support posts and pockets 36 may receive side tent support posts, or they may be used for other carrying purposes. Straps 38 and 40 are provided for forming the necessary shoulder or back strap carrying members once the kit has been assembled. Loops 42 are provided to reduce strain on the various strap members at their point of securement adjacent the pockets 36.

On the outer edges of panels 4 and 6 is provided a zipper 44. The zipper extends to the top of the outer edge of panels 4 and 6 and ends there. The purpose of this zipper is for forming the sleeping bag shown in FIG. 4.

In addition to the zipper 44, a pair of parallel zippers 46 are provided. The purpose of these zippers is for assembling the carrying case or kit 48 generally shown in FIG. 7.

It will be noted that the zippers 44 and 46 at their beginning are not stitched directly on to the fabric so as to leave a small dangling free portion to enable the one assembling the sleeping bag or carrying kit to start zippers 44 and 46 in motion without difficulty. It will be noted that the upper portion of the zippers 46 are offset from the lower portion of the zippers. The purpose for this will be obvious when the Pack is assembled into a carrying case or kit 48.

Creases or fold lines on panel 4 will be provided as at 50, 52, 54 and 56 for purposes hereinafter described.

CONSTRUCTION OF THE TENT

FIG. 9 shows the tent T in erected form. Center stakes 58 would be counted in to support the central panels 4 and 6 to form the ridge. Side stakes 60 would be used to support the side panels 2 and would be secured by stake support means 28. Zipper 32 would then be zipped to bring flaps 16 and 20 together and flaps 12 and 24 would be snapped together at two flaps 16 and 20 be means of snaps 26 or other similar fastening means. It is obvious that the zippers could be replaced by Velcro or other snap fasteners or the like. In the case where the sleeping bag is integral with the tent, the pockets 34 and 36 would be on the inside of the tent construction on panel 4 for use by the occupant.

ASSEMBLING THE SLEEPING BAG

In assembling the sleeping bag, end flaps 10, 12, 14, 16, 18, 20, 22 and 24 are folded underneath as shown in FIG. 2. Subsequently, panels 2 and 8 are folded underneath as shown in FIG. 3. Panel 6 is then folded along the center seam 62 underneath the panel 4 and zipper 32 is then zipped to join the edges of panels 4 and 6 together. This arrangement thus makes a sleeping bag out of the tent. A blanket or the like can be used within the pocket formed by the panels 4 and 6 and between the various folded in flaps at panels 2 and 8. The under portion of panels 4 and 6 could be of special insulated material or quilting laminated or otherwise stitched or secured to the underneath side for additional warmth, although this is not shown in the drawings.

It is obvious that the panels 4 and 6 may be snapped by means of snaps 64 to sub-panels 66 and 68 as shown in FIG. 8. This would then permit the removal of the sleeping bag constructed from panels 4 and 6 for use within the tent as will be obvious from a study of FIGS. 8 and 9.

THE ASSEMBLY OF THE CARRYING KIT

The carrying kit 48 is assembled in a manner illustrated in FIGS. 5, 6 and 7. The steps taken in the formation of the sleeping bag as finalized in FIG. 4, and as illustrated in FIGS. 1, 2 and 3, are initial steps in the formation of the kit 48. After the formation of the sleeping bag as illustrated in FIG. 6, the lower portion of the panel 4 is folded under along the crease 50 as illustrated in FIG. 5. Subsequently, panel 4 is folded along the creases 52 as illustrated in FIG. 6, and then the panel 4 is again folded along the creases 54 and 56 bringing the zipper members 46 together so that the zippers 46 can be zipped up forming the pack into a pillow with the pockets 34 at the sides thereof. Straps 38 and 40 are then lashed around the pillow or assembled kit 48 and tied or buckled by buckles (not shown) for carrying or slinging on the back or on a back pack carrier (not shown).

While this invention has been described, it will be understood that it is capable of further modification, and the application is intended to cover any variations, used and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

Having thus described my invention what I claim is:

1. A camping pack comprising:
a. a tent assembly,
b. a sleeping bag assembly,
c. a carrying kit assembly,
d. each of said assemblies is being joined to each other,
e. said assemblies forming in non-assembled position a substantially planar, sheet-like article having four panels,
f. each of said panels having at each end thereof a flap,
g. said pack including fastening means for securing said flaps and panels together into one or the other of said assemblies,
h. said four panels being rectangular and arranged in side-by-side relation there being two central panels and two outer panels and said outer panels being on either side of said central panels.
i. and said central panels comprising substantially the whole of said carrying kit assembly.

2. A camping pack as in claim 1 and wherein:
a. said outer panels form the side walls of said tent assembly and said central panels form the top walls of said tent assembly.

3. A camping pack as in claim 2 and wherein:
a. said flaps at the end of said panels comprise the end closures of said tent assembly.

4. A camping pack as in claim 3 and wherein:
a. said flaps at the end of said central panels are triangular in shape.

5. A camping pack as in claim 4 wherein:
a. said flaps at the ends of said outer panels are rectangular.

6. A camping pack as in claim 3 and wherein:
a. said fastening means includes zipper means for said central panel adjacent end flaps for securing said adjacent flaps together.

7. A camping pack as in claim 3 and wherein:
a. said fastening means includes snap means for said adjacent end flaps of said central panels and said flaps adjacent to said adjacent end flaps of said central panels for securing adjacent flaps and outer flaps together.

8. A camping pack as in claim 3 and wherein:
a. said fastening means includes means for said central panels for securing said central panels together.

9. A camping pack as in claim 8 and wherein:
a. said fastening means for said central panels includes zipper means.

10. A camping pack as in claim 8 and wherein:
a. said fastening means for said central panels includes zipper means for forming said sleeping bag assembly.

11. A camping pack as in claim 8 and wherein:
a. said fastening means for said central panels includes zipper means for forming said carrying bag assembly.

12. A camping pack as in claim 8 and wherein:
a. said fastening means for said central panels includes means for removably securing said camping bag assembly to said tent assembly.

13. A camping pack as in claim 1 and wherein:
a. said carrying kit assembly includes pockets and carrying straps.

14. A camping pack as in claim 13 and wherein:
a. said pockets and said carrying straps are mounted on one of said central panels.

15. A camping pack as in claim 13 and wherein:
a. said central panels include two sets of zippers, one set being for said sleeping bag assembly and the other set being for said carrying bag assembly.

16. A camping pack comprising:
a. a tent assembly,
b. a sleeping bag assembly,
c. a carrying kit assembly,
d. each of said assemblies being joined to each other,
e. said assemblies forming in non-assembled position a substantially planar, sheet-like article having four panels,
f. said four panels being rectangular and arranged in side-by-side relation there being two central panels and two outer panels and said outer panels being on either side of said central panels,
g. said central panels comprising substantially the whole of said carrying kit assembly,
h. said central panels having at each end thereof a flap, and
i. said pack including fastening means for securing said flaps and panels together into one or the other of said assemblies.

* * * * *